US008898938B2

(12) United States Patent
Stone

(10) Patent No.: US 8,898,938 B2
(45) Date of Patent: Dec. 2, 2014

(54) ARTICLE HAVING A MULTIDIRECTIONAL DISPLAY

(76) Inventor: Carol Mary Stone, Del Mar, CA (US)

( * ) Notice: Subject to any disclaimer, the term of this patent is extended or adjusted under 35 U.S.C. 154(b) by 0 days.

(21) Appl. No.: 11/855,460

(22) Filed: Sep. 14, 2007

(65) Prior Publication Data

US 2008/0066354 A1 Mar. 20, 2008

Related U.S. Application Data

(60) Provisional application No. 60/825,714, filed on Sep. 14, 2006.

(51) Int. Cl.
*G09F 1/00* (2006.01)
*B24D 15/04* (2006.01)

(52) U.S. Cl.
CPC *G09F 1/00* (2013.01); *B24D 9/007* (2013.01); *B24D 15/04* (2013.01)
USPC ..... 40/124.06; 40/124.11; 40/124.09

(58) Field of Classification Search
USPC ..... 40/124.06, 124.11, 124.09
See application file for complete search history.

(56) References Cited

U.S. PATENT DOCUMENTS

| | | | | | |
|---|---|---|---|---|---|
| 1,816,542 | A * | 7/1931 | Mellin | 206/463 |
| 2,866,544 | A * | 12/1958 | Klein et al. | 206/489 |
| 3,173,540 | A * | 3/1965 | Lapides | 206/463 |
| 3,587,848 | A * | 6/1971 | Froehlig | 206/462 |
| 4,149,630 | A * | 4/1979 | Transport | 206/45.24 |
| 4,430,843 | A | 2/1984 | Favale | |
| 4,584,213 | A | 4/1986 | Rentowl | |
| 4,779,734 | A * | 10/1988 | Kydonieus | 206/470 |
| 4,787,160 | A * | 11/1988 | Balsamo | 40/124.12 |
| 4,840,275 | A * | 6/1989 | Faiola et al. | 206/423 |
| 4,870,764 | A * | 10/1989 | Boone | 40/124.06 |
| 4,951,404 | A * | 8/1990 | Lithwick | 40/124.06 |
| 5,096,058 | A * | 3/1992 | Juravin et al. | 206/232 |
| 5,117,569 | A | 6/1992 | Bean | |
| 5,354,395 | A | 10/1994 | Fernandez et al. | |
| 5,607,101 | A * | 3/1997 | Saito | 229/71 |
| 5,845,425 | A * | 12/1998 | Leake et al. | 40/725 |
| 5,863,414 | A * | 1/1999 | Tilton | 206/470 |
| 6,076,675 | A * | 6/2000 | Pawlowski | 206/459.5 |
| 6,478,336 | B2 * | 11/2002 | Tran | 281/29 |
| 6,843,007 | B2 * | 1/2005 | Santarpia | 40/124.06 |
| 7,096,615 | B2 * | 8/2006 | Gardi | 40/124.06 |
| 7,322,134 | B2 * | 1/2008 | Cheek et al. | 40/124.12 |
| 7,621,405 | B2 * | 11/2009 | Schweitzer et al. | 206/703 |
| 2005/0039356 | A1 * | 2/2005 | Harlick | 40/124.06 |
| 2006/0278539 | A1 * | 12/2006 | Fager | 206/0.82 |
| 2007/0113432 | A1 * | 5/2007 | Poole | 40/124.06 |

* cited by examiner

*Primary Examiner* — Charles A Fox
*Assistant Examiner* — Christopher e Veraa
(74) *Attorney, Agent, or Firm* — Mastermind IP Law P.C.; Diane L. Gardner

(57) ABSTRACT

The present invention relates to articles having die cut portions that form a window or a frame-like structure. Set into the window or frame-like structure is an object, affixed or mounted in transparent material, such that the object is visible from both the front and the rear of the article.

6 Claims, 4 Drawing Sheets

ARTICLE HAVING A MULTIDIRECTIONAL DISPLAY

This application claims priority from U.S. Provisional Patent Application No. 60/825,714, filed on Sep. 14, 2006, incorporated herein by reference.

BACKGROUND

Conventional flat stationery articles have many configurations for incorporation of display objects into the article itself. For example, it is known in the art to provide greeting cards having cutouts or windows in the front panel of the card for displaying features on the rear panel of the card. It is also known in the art to provide greeting cards having an opaque or transparent sheet situated between the front and rear panels of the card so as to enhance or modify the features on the rear panel of the card once the front panel of the card is lifted away from the rear panel. It is also known in the art to provide greeting cards having a cutouts or windows in the front panel of the card, wherein an article is affixed on or in one or more transparent sheets affixed to the inner side of the front panel of the card.

SUMMARY OF THE INVENTION

The present invention relates to articles having die cut portions that form a window or a frame-like structure. Set into the window or frame-like structure is an object, affixed or mounted in transparent material, such that the object is visible from both the front and the rear of the article.

DETAILED DESCRIPTION

Figure 1:
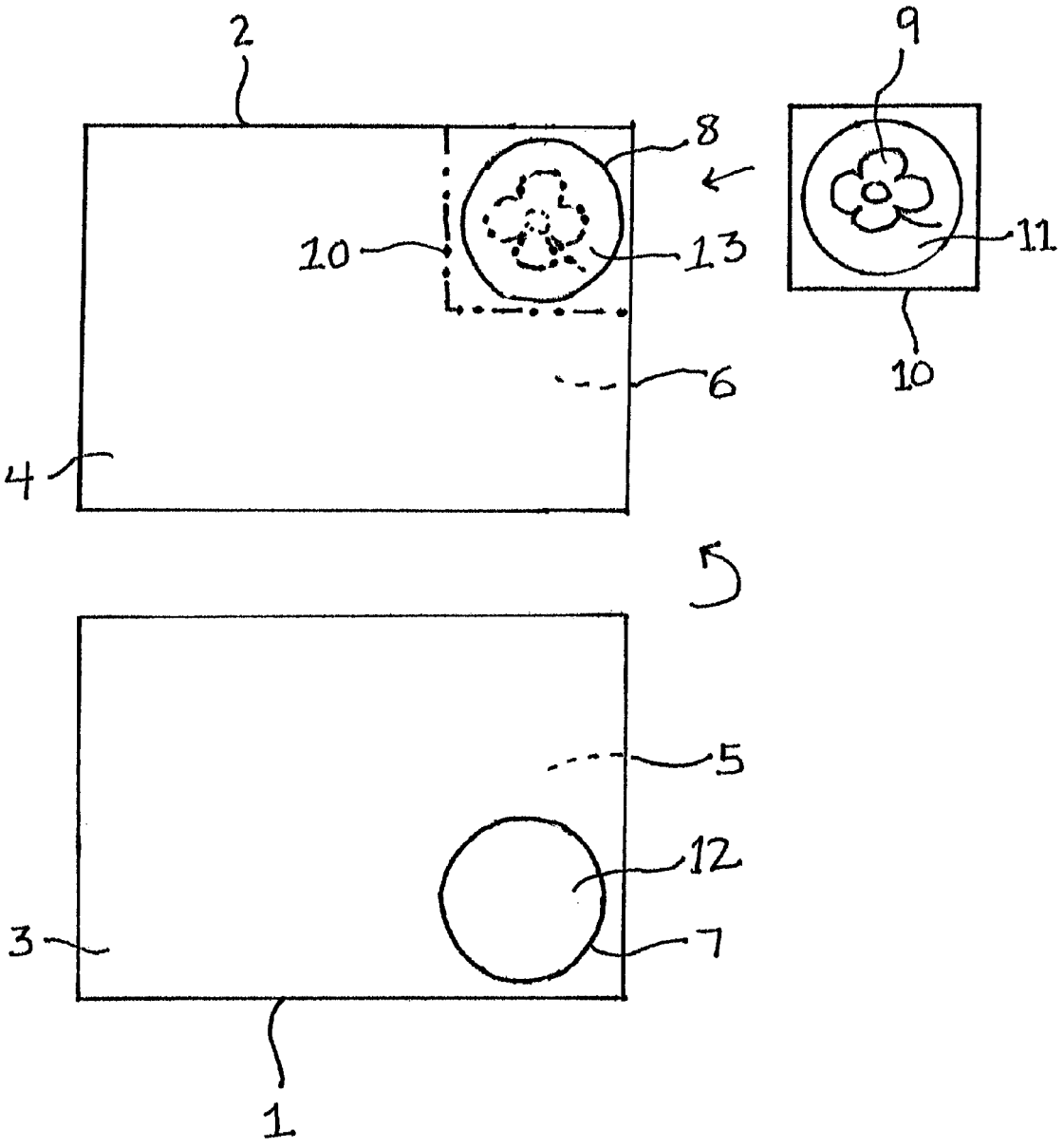
FIG. 1 depicts a post card comprised of two separate panels on either side of a display object in a housing element.
Figure 2:
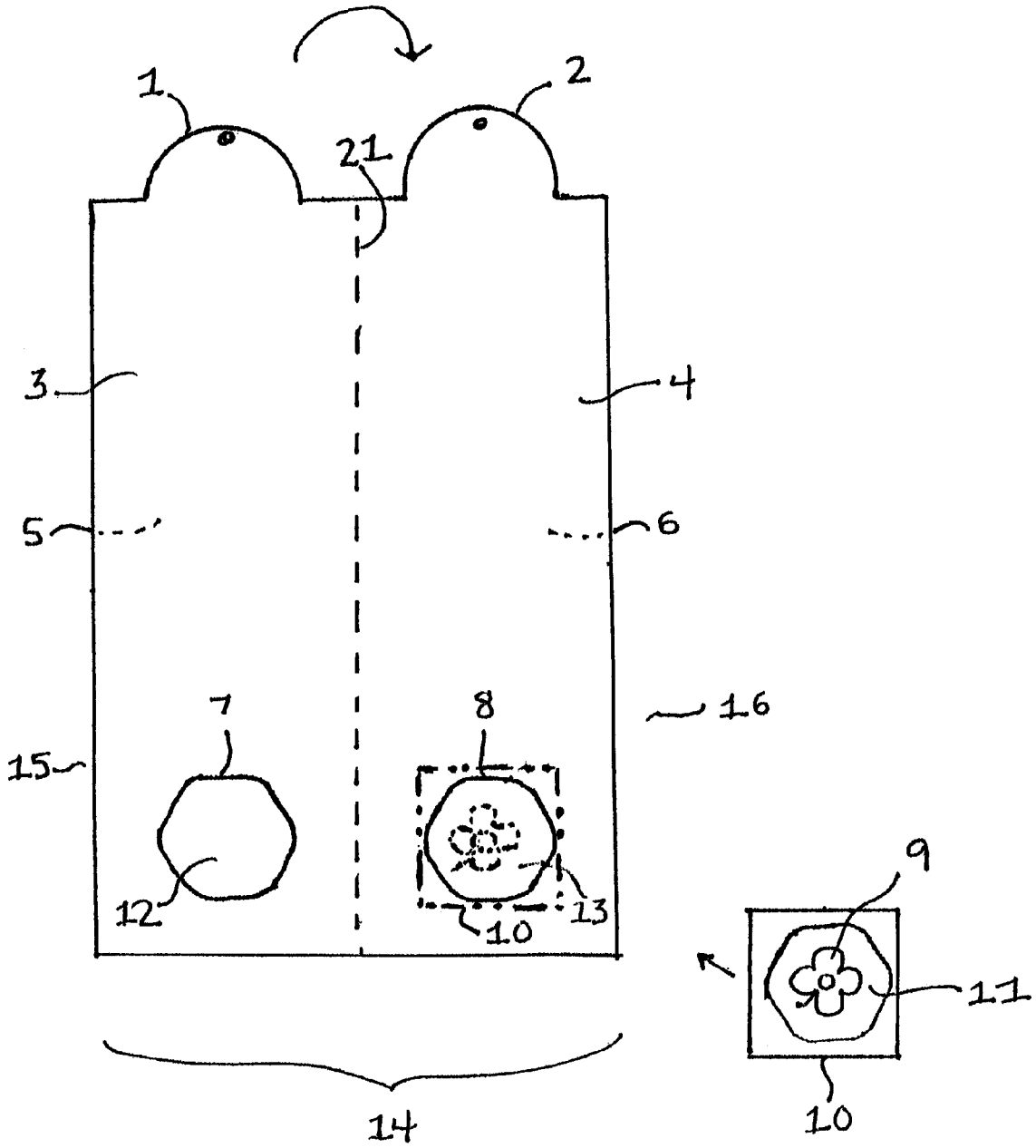
FIG. 2 depicts a bookmark comprised of a single panel that is folded along the center axis to form two panels on either side of a display object in a housing element.
Figure 3:
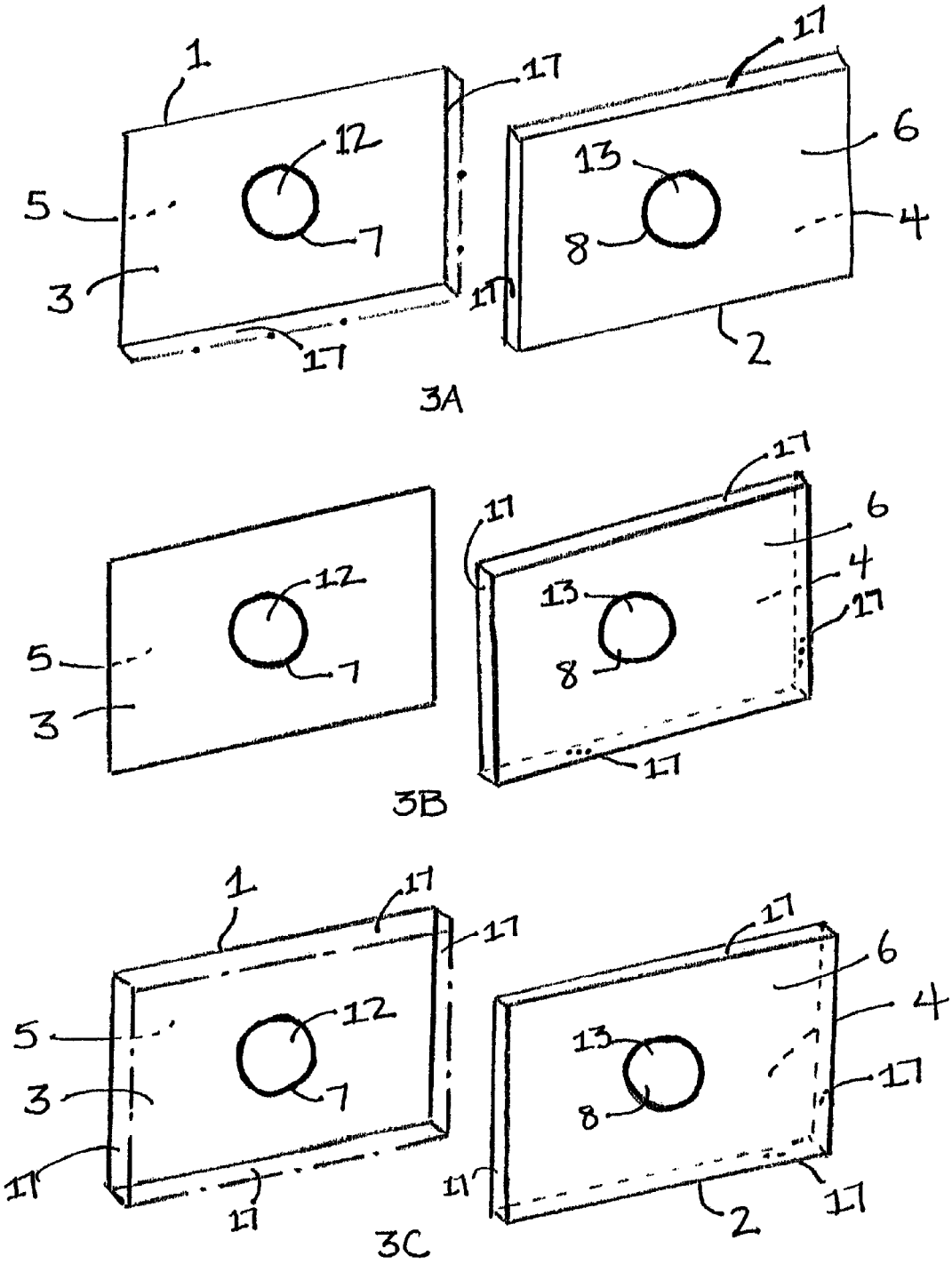
FIG. 3 depicts various examples of flap configurations for constructing a picture frame from two separate panels.
Figure 4:
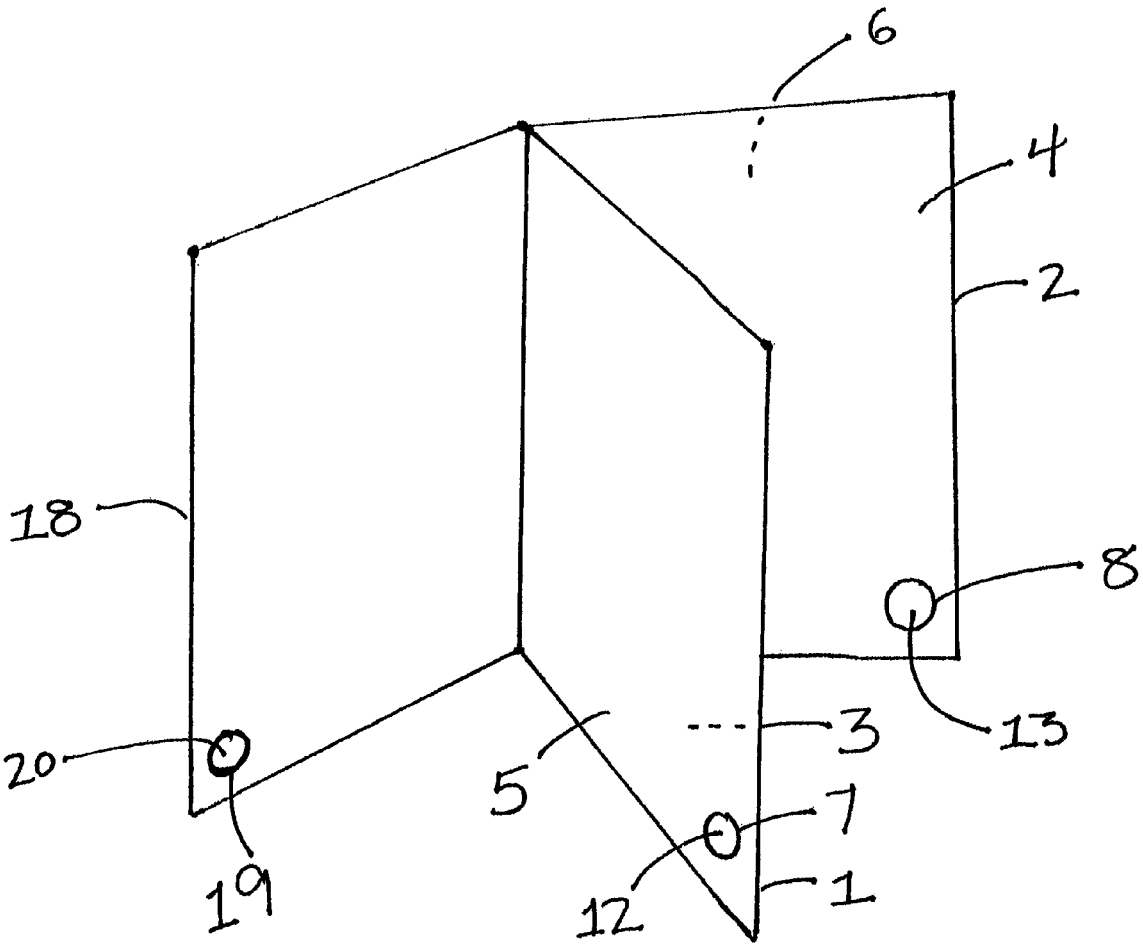
FIG. 4 depicts a greeting card having an additional panel for use as the front cover of the card.

For the purposes of this description, the terms "a," "an" and "the" mean "one or more" unless expressly specified otherwise. The enumerated listing of items does not imply that any or all of the items are mutually exclusive, unless expressly specified otherwise. The terms "including," "comprises" and "comprising" and variations thereof mean "including but not limited to" unless expressly specified otherwise, and should not be interpreted as being limitative to the elements listed thereafter. A description of an embodiment with several components does not imply that all such components are required. Although process steps or the like may be described in a sequential order, such process steps may be configured to work in alternate orders as practical. Unless otherwise specified in the description, all words used herein carry their common meaning as understood by a person having ordinary skill in the art. In cases where examples are listed, it is to be understood that combinations of any of the alternative examples are also envisioned. The scope of the invention is not to be limited to the particular embodiments disclosed herein, which serve merely as examples representative of the limitations recited in the issued claims resulting from this application, and the equivalents of those limitations.

The article may be any relatively thin, flat-shaped item. Examples of articles useful in this invention include but are not limited to greeting cards, postcards, bookmarks, recipe cards, envelopes, tickets, coupons, identification cards, business cards, stationary, gift bags, passes, ornaments, notepads, scorecards, pamphlets, key chains, drink coasters, picture frames and the like. The article may be made from any material suitable for the article's intended use. The material is preferably rigid or semi-rigid. Examples of suitable materials include but are not limited to paper, paperboard, cardboard, wood, plastic, vinyl, foam, neoprene, polymers and co-polymers, fiberglass, rubber, metal, cloth, cellulose, cork, resins, PVC and combinations thereof.

The article has at least one die cut portion 7, 8, 19 forming a hole or window 12, 13, 20 traversing the article from a front panel 1 to a rear panel 2, each panel having an inner side 3, 4 and outer side 5, 6, the two panels being mirror images of one another. The article therefore forms a frame-like structure surrounding the hole. The one or more holes or windows 12, 13 may be of any size and shape such that they do not interfere with the intended purpose of the article. The cuts may be made separately in the panels, so long as the cuts are uniform from one panel to the next. In another embodiment, the cuts may be made at one time by first positioning the front and rear panels together as a unit. The die cuts can be made by any conventional means, including but not limited to sharp steel stamps or rollers or manual cutting. These and other methods of performing the die cuts are readily known by those persons having ordinary skill in the art.

The front panel 1 and rear panel 2 of the article are joined along their inner sides 3, 4 so as to form a single unit. In one embodiment, the front panel 1 and rear panel 2 may be formed from two separate panels that are mirror images of one another. The two panels are aligned and then superimposed upon one another to form a single unit.

In another embodiment, the front panel 1 and rear panel 2 may be formed from a single panel 14 having opposing halves 15, 16 that are mirror images of one another. Each half represents either the front panel 1 or the rear panel 2. In this embodiment, the panel 14 is folded over itself at the axis 21 about which the mirrored, opposing halves 15, 16 are positioned, and the two halves are joined along their inner sides 3, 4 so as to form a single unit. The axis 21 may be scored to facilitate proper folding.

The display object 9 can be anything of a size and shape suitable for article in which it is housed. The display object 9 may be thinner than, equal to or thicker than the article. Where the display object 9 is thicker than the article in which it is housed, it should be of a thickness that does not interfere with the intended use of the article. The range of display objects is otherwise virtually limitless. Examples include but are not limited to dried flowers, leaves, die cut objects, coins, feathers, charms, paper goods, insects, buttons, beads, seeds, non-perishable foods, ribbons, and the like.

The display object 9 may be placed, fixed, mounted or otherwise situated within a clear, translucent or opaque housing element 10, such that the display article 9 is visible from both the front and the rear of the article. For example, the object may be situated between two pieces of clear, transparent or opaque material that are joined to form the housing element 10. The material may vary in finish and in thickness. The material may be joined by any conventional method including but not limited to lamination, thermo-welding, adhesion and magnetism. The housing element may be colorless or tinted. The housing element 10 may contain more than one display object 9. In one embodiment, the display object 9 is immobilized within the housing element 10. In another embodiment, the display object 9 is in an air-tight environment within the housing element 10. In yet another embodiment, the display object 9 is in a liquid, semi-liquid, or viscous environment within the housing element 10. The display object 9 may be contained within a compartment 11 which is situated within the housing element 10.

The housing element 10 is situated between the front panel 1 and rear panel 2 of the article, at the location of the window 12, 13, 20 formed from the die cut portion 7, 8, 19, so as to properly exhibit the display article 9 from the front and rear as desired. The housing element 10 extends beyond the perimeter of the window 12, 13, 20 such that joinder of the front panel 1 and rear panel 2 maintains the perimeter of the housing element 10 between the interface of their inner sides. The perimeter of the housing element 10 may be of any size suitable to maintain its position after joinder of the inner sides 3, 4 of the front and rear panel. The appropriate size may be in the range of slightly larger than the perimeter of the window 12, 13, 20 to equal in size to the front panel 1 and rear panel 2.

The inner sides 3, 4 of the front panel 1 and rear panel 2 are joined by use of adhesive and optionally with co-adhesives. The type of adhesive required is determined by the type of substrate to which it will be applied, the facestock of the panel and the method in which it will be applied. Appropriate adhesives are readily known by those persons having ordinary skill in the art. The adhesive may be applied to either or both of the inner sides 3, 4 of the front panel 1 and rear panel 2. Additionally, the adhesive may be applied to either or both sides of the portion of the perimeter of the housing element 10 that is not visible from the outside of the article. Where the housing element 10 is the same size as the front panel 1 and rear panel 2, the adhesive is preferably applied to both the inner sides 3, 4 of the front panel 1 and rear panel 2 as well as both sides of the appropriate area on the housing element 10. After the inner sides 3, 4 of the opposing panels 1, 2 are joined, the perimeter edges may be trimmed.

The article may optionally comprise one or more additional panels 18 on its exterior by adhering the additional panels 18 to the outer sides 5, 6 of the front panel 1 and/or rear panel 2 and therefore across the housing element 10 as well. For example, the entire article may be laminated or otherwise covered with materials including but not limited to acrylic, plastic or other appropriate materials readily apparent to any person having ordinary skill in the art.

In another embodiment, at least one of the front panel 1 and rear panel 2 optionally has one or more flaps 17 located at the perimeter and folding away from the outer side of the panel 1, 2. Where one opposing panel 1, 2 comprises a flap 17 and the other panel 1, 2 does not, the flap 17 is joined to the perimeter edge of the opposing panel 1, 2. Where both opposing panels 1, 2 comprise flaps 17, the panels 1, 2 may be joined at the flaps 17. Joinder at a flap 17 may be at the outer edge of the flap 17 or overlapping the flap 17. Where the article comprises one or more flaps 17, the article may be somewhat hollow or otherwise contain space between the opposing panels 1, 2. The two panels 1, 2 and optional flaps 17 may also be formed from a single panel 14 that is folded over itself. While the two opposing panel halves 15, 16 should be symmetrical, the flap 17 portions do not have to be. In one embodiment, the panels 1, 2 comprising one or more flaps 17 form a picture frame, and the display object 9 contains one or more pictures or photographs visible from both sides of the article.

The article may comprise one or more additional elements depending upon the intended use for the article. For example only, where the article is a greeting card, an additional panel 18 may be included as the front cover of the card, wherein the additional panel 18 contains a die cut 19 of the same size and shape of the panel 1, 2 adjacent to it. In this embodiment, the display article 9 is visible from all sides whether the card is open or closed.

Where the article is a note pad, removable paper sheets may be included on one side of the article, wherein the sheets contain a die cut 19 of the same size and shape of the panel 1, 2, 18 adjacent to it such that the display article 9 is visible at all times. When all of the optional sheets of paper have been removed, the display article 9 remains as a memento.

The article may comprise additional elements readily apparent to any person having ordinary skill in the art. Such elements depend upon the intended use for the article and include but are not limited to tassles, hang-ties, ropes, strings, hangers, and chains.

The invention claimed is:

1. An article having a multidirectional display area comprising a) at least one housing element formed from at least one display item situated within a housing material, said housing material enabling visibility of the display item from all sides of the housing material;

b) at least two uniformly shaped, opposing panels each having an inner and an outer side, each panel further having as a portion of its uniform shape at least one opposing die cut section, said panels being joined to form a unitary frame around said at least one housing element situated and affixed therebetween; wherein at least one of said at least two uniformly shaped, opposing panels comprises one or more foldable flaps, said one or more foldable flaps used for joining the opposing panels such that a hollow space is formed between said panels;

whereby said at least one opposing die cut section in every said panel is capable of being superimposed so as to traverse said article such that when all said panels are superimposed, said display item is capable of being viewed at least from each outer side of the outermost panels; and wherein every panel present in said article is uniformly shaped and includes said at least one opposing die cut section.

2. The article of claim 1, wherein said uniformly shaped, opposing panels are made from materials selected from the group consisting of paper, paperboard, cardboard, wood, plastic, vinyl, foam, neoprene, polymers and co-polymers, fiberglass, rubber, metal, cloth, cellulose, cork, resins, PVC and combinations thereof.

3. The article of claim 1, wherein said housing material is comprised of material selected from the group consisting of colorless and tinted.

4. The article of claim 1, wherein said at least one display item is immobilized within said housing material.

5. The article of claim 1, wherein said housing element comprises a substance selected from the group consisting of liquid, semi-liquid or viscous.

6. The article claim 1, wherein said at least two opposing panels are joined with adhesives.

* * * * *